US005391037A

United States Patent [19]

Enderlin et al.

[11] Patent Number: 5,391,037

[45] Date of Patent: Feb. 21, 1995

[54] RACK FOR SUPPORTING BOBBINS OF TEXTILE FILAMENT

[75] Inventors: Robert Enderlin, Morschwiller; Clément Meyer, Bernwiller; Antoine Chochol, Kingersheim, all of France

[73] Assignee: Superba, Mulhouse, France

[21] Appl. No.: 952,652

[22] Filed: Sep. 28, 1992

[30] Foreign Application Priority Data

Oct. 2, 1991 [FR] France ..... 91 12124

[51] Int. Cl.[6] ..... B65H 49/38

[52] U.S. Cl. ..... 414/276; 414/281; 242/132; 242/130

[58] Field of Search ..... 414/911, 276, 281, 626; 242/35.5 A, 35.5 T, 130, 132

[56] References Cited

U.S. PATENT DOCUMENTS

| | | | |
|---|---|---|---|
| 571,389 | 11/1896 | Pancoast | 414/276 |
| 4,555,215 | 11/1985 | Raasch et al. | 242/35.5 A |
| 4,676,061 | 6/1987 | Yamamoto | 242/35.5 A |
| 4,723,885 | 2/1988 | Grube et al. | 414/276 |
| 4,724,666 | 2/1988 | Kupper | 242/35.5 A |
| 4,836,468 | 6/1989 | Singer . | |
| 5,083,716 | 1/1992 | Colli et al. | 242/35.5 A |
| 5,096,357 | 3/1992 | Galbani | 414/911 |
| 5,170,954 | 12/1992 | Derichs | 242/35.5 A |
| 5,207,547 | 5/1993 | Kawamura | 414/911 |
| 5,226,922 | 7/1993 | Mori | 242/35.5 A |
| 5,247,969 | 9/1993 | Raaijmakers et al. | 242/35.5 A |

FOREIGN PATENT DOCUMENTS

| | | | |
|---|---|---|---|
| 2531687 | 2/1984 | France . | |
| 2543931 | 10/1984 | France . | |
| 1969002 | 9/1967 | Germany . | |
| 3502611 | 7/1986 | Germany . | |
| 827365 | 5/1981 | U.S.S.R. | 242/35.5 A |

*Primary Examiner*—David A. Bucci
*Assistant Examiner*—Gregory A. Morse
*Attorney, Agent, or Firm*—Young & Thompson

[57] ABSTRACT

The rack (1) for supporting bobbins (2) of filament is made up of several superposed rows of bobbins (2) mounted on spindles (X-X'). The rack (1) has a zone (3) for intermediate storage of bobbins (2) in which said bobbins are placed next to each other on a support (4), a conveyor (7, 8) being provided for automatically conveying the bobbins (2) to the storage zone. To be used for rationalizing the transfer of bobbins and the positioning of bobbins in a rack.

18 Claims, 9 Drawing Sheets

RACK FOR SUPPORTING BOBBINS OF TEXTILE FILAMENT

The present invention relates to a rack for supporting bobbins of textile filament.

Racks of this type are already known. They support superposed rows of bobbins and filaments extending from said bobbins are transferred into processing installations such as a line for heat-setting by steam under pressure, or another textile machine.

The bobbins are mounted on spindles which are rigidly fixed to the rack in order to permit unwinding of the filament of the bobbins.

At the present time, full bobbins are placed in an intermediate storage area located at a distance from the rack. These bobbins are transported by hand or by means of a trolley from the location at which they are formed to the rack and are engaged one by one on the corresponding spindles of the rack whenever they are required.

In view of the fact that each bobbin weighs 4 to 5 kg and that it is planned in future to form even heavier bobbins, transporting of these bobbins and placing them in position in the rack are very tiring for personnel and sometimes cause irregular supply of the rack with bobbins which are liable to interfere with the performance of subsequent operations.

A further drawback arises from the considerable human means required for moving and handling all these bobbins, thus resulting in high cost of the entire yarn formation process.

The object of the present invention is to overcome the above-mentioned disadvantages by improving the conditions of supply of the rack with full bobbins and of positioning of these latter on the spindles provided for this purpose in the rack.

The invention is thus directed to a rack for supporting bobbins of filament, located upstream of a textile installation towards which the filament unwound from said bobbins is conveyed, said rack being made up of several superposed rows of bobbins mounted on spindles.

In accordance with the invention, said rack is characterized in that it has a zone for intermediate storage of bobbins in which said bobbins are placed next to each other on a support, means being provided for automatically conveying the bobbins to said intermediate storage zone.

These conveying means thus make it possible to transport the full bobbins automatically towards the rack, thereby dispensing with the handling operations employed up to the present time.

Moreover, the storage zone which is preferably located above the rack enables an operator to withdraw the bobbins one after the other with great ease in order to position them on the rack spindles in the place of empty bobbins.

The storage zone considerably facilitates handling operations performed by the operator since this zone puts the bobbins within reach of the operator's hands and in a position in which the operator can withdraw them easily with the minimum number of movements.

In an advantageous embodiment of the invention, the bobbins are transported along rails from which the bobbins are suspended by means of supports comprising pins on which are engaged the spools of the bobbins, said pins being inclined with respect to the horizontal, said supports being intended to form stops for said bobbins and being attached to the pin at the bottom end of this latter.

These pins thus hold the bobbins in position without any need to place any stopping means at the free ends of the pins, thus facilitating subsequent withdrawal of bobbins.

In a preferred embodiment of the invention, said storage zone is constituted by an inclined ramp on which the bobbins are placed next to each other, said ramp being provided at its opposite ends with walls forming stops for the bobbins, said ramp being inclined in the direction of the row of bobbins and being horizontal in the directions at right angles to this latter.

In accordance with another particular feature of the invention, means are provided for transferring a bobbin in position on its support having an inclined axis to the top end of the ramp.

Preferably, the rack has a second ramp extending next to the first ramp and having a slope opposite to that of the first ramp, the bottom end of the first ramp being such as to correspond to the top end of the second ramp.

The second ramp makes it possible to increase the capacity for storage of bobbins of the intermediate storage zone. Furthermore, their opposite slopes permit easy transfer of the bobbins from the first ramp to the second ramp as will be explained in greater detail in the description.

Other particular features and advantages of the invention will become further apparent from the following description.

In the accompanying drawings which are given by way of non-limitative example:

Figure 1:
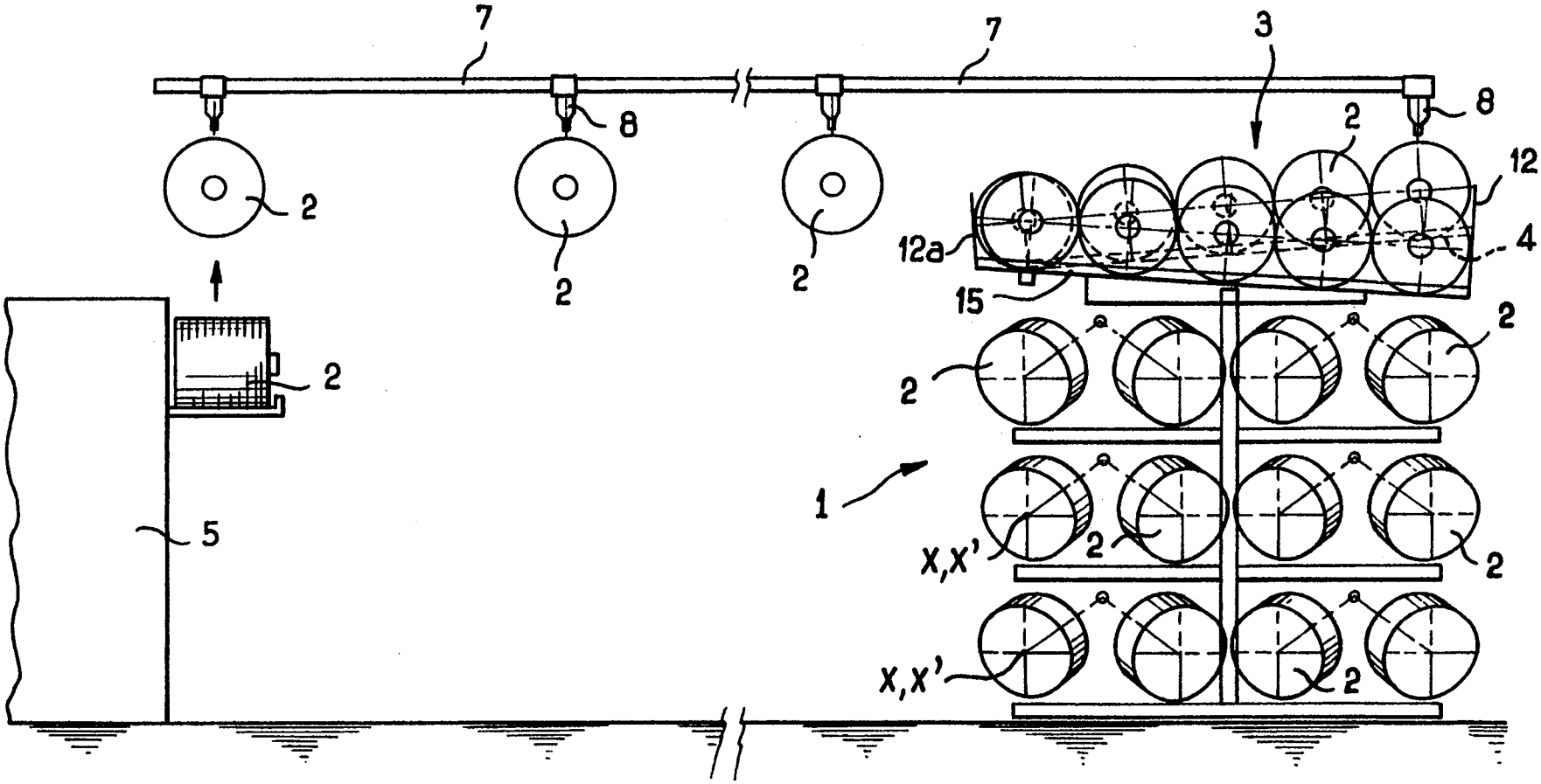
FIG. 1 is a view in partial elevation of a rack in accordance with the invention and the means for conveying the bobbins to said rack.

In the embodiment of FIGS. 1 and 4 to 7, there has been shown a rack 1 for supporting bobbins of filament 2 upstream of a textile installation (not shown) into which the filament unwound from said bobbins 2 is directed. This installation can be a line for heat-setting by steam under pressure, for example.

Said rack 1 is formed by a plurality of identical modules (see FIGS. 4, 6) each made up of several superposed rows of bobbins 2 rotatably mounted on spindles X, X'.

In accordance with the invention, each module of the rack has a zone 3 for intermediate storage of the bobbins 2 in which said bobbins are placed next to each other on a flat support 4. Moreover, means which will be described in detail below are provided for automatically conveying the bobbins 2 to said intermediate storage zone 3.

In the example of FIG. 1, the bobbins 2 are conveyed successively to the storage zone 3 from an installation 5 which delivers bobbins 2 in a continuous manner.

In the embodiments which are illustrated, the intermediate storage zone 3 extends above the rows of bobbins 2 which are in an operational position, that is to say in readiness for supplying a textile installation with a large number of filaments.

The storage zone 3 includes at least one detector 6 for detecting the presence of a bobbin in said storage zone 3. Said detector 6 cooperates with suitable means known per se in order to control the displacement of the means for conveying the bobbins 2 so as to fill the space resulting from the withdrawal of a bobbin 2.

Figure 2:
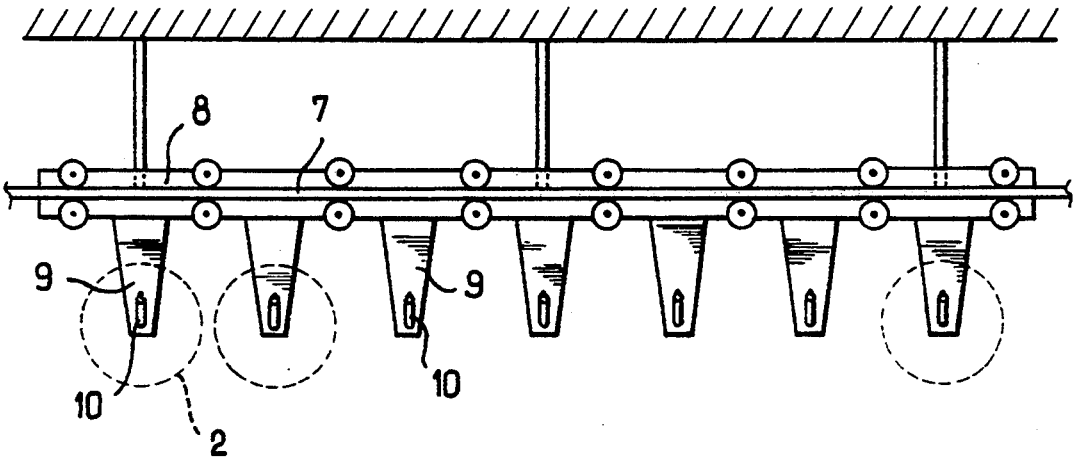
FIG. 2 is a fragmentary view in elevation of the rail and of the bobbin supports for conveying the bobbins.
Figure 3:
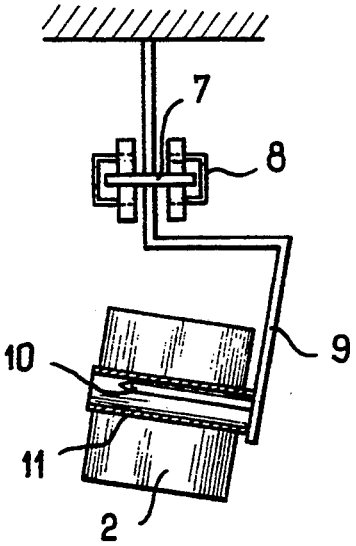
FIG. 3 is a view of a bobbin support showing its inclined pin for receiving a bobbin.

As indicated in FIG. 1, the bobbins 2 are conveyed along horizontal rails 7 from which the bobbins 2 are suspended by means of sliding supports 8. These supports 8 are provided at their lower ends 9 (as shown in FIGS. 2 and 3) with pins 10 on which are engaged the spools 11 (cardboard tubes) of the bobbins 2. FIG. 3 shows in particular that the pin 10 attached to the support 9 forms a stop for the bobbin 2 by reason of the fact that it is attached to the pin 10 at the bottom end of this latter.

In the example of FIGS. 1, 4, 5 and 7, the zone 3 for storage of the bobbins is constituted by an inclined ramp 4 of sheet metal, for example, on which the bobbins 2 are placed next to each other. Said ramp is provided at the opposite ends thereof with walls 12, 12a forming stops for the bobbins 2. Moreover, the ramp 4 is inclined in the direction of the row of bobbins 2 and is horizontal (see FIG. 5) in the directions at right angles to this latter.

Figure 4:
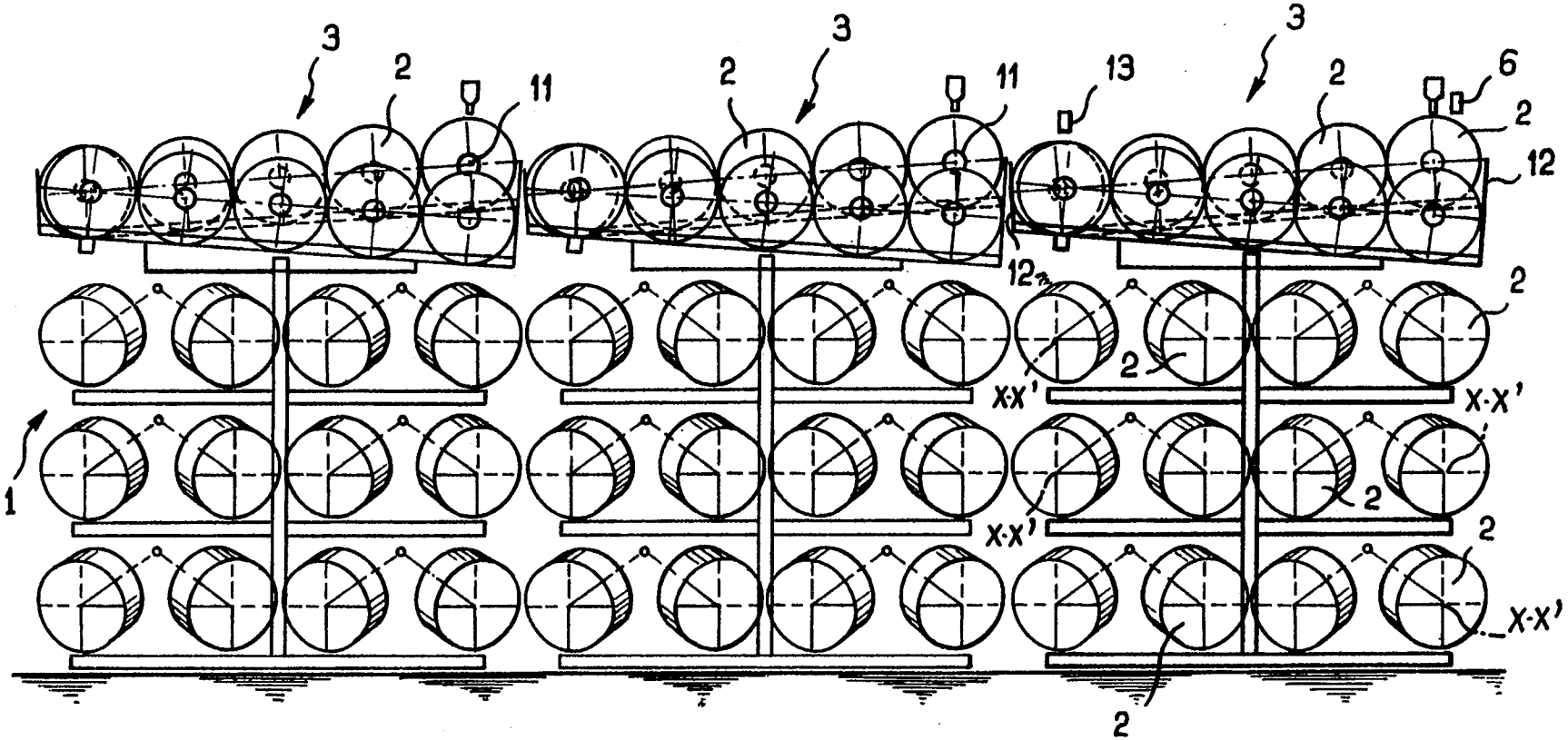
FIG. 4 is a view in elevation of the rack in accordance with the invention, constituted by a plurality of modules.

It is also apparent from FIG. 4 that detectors 6, 13 are provided for detecting a bobbin 2 at each end of the ramp. The function of these detectors 6, 13 will be explained hereinafter.

In accordance with another particular feature of the invention, means are provided for transferring a bobbin 2 from a position on its support 8 which has an inclined pin 10 and is fastened to the conveying rail 7 to the top end of the ramp.

Figure 5:
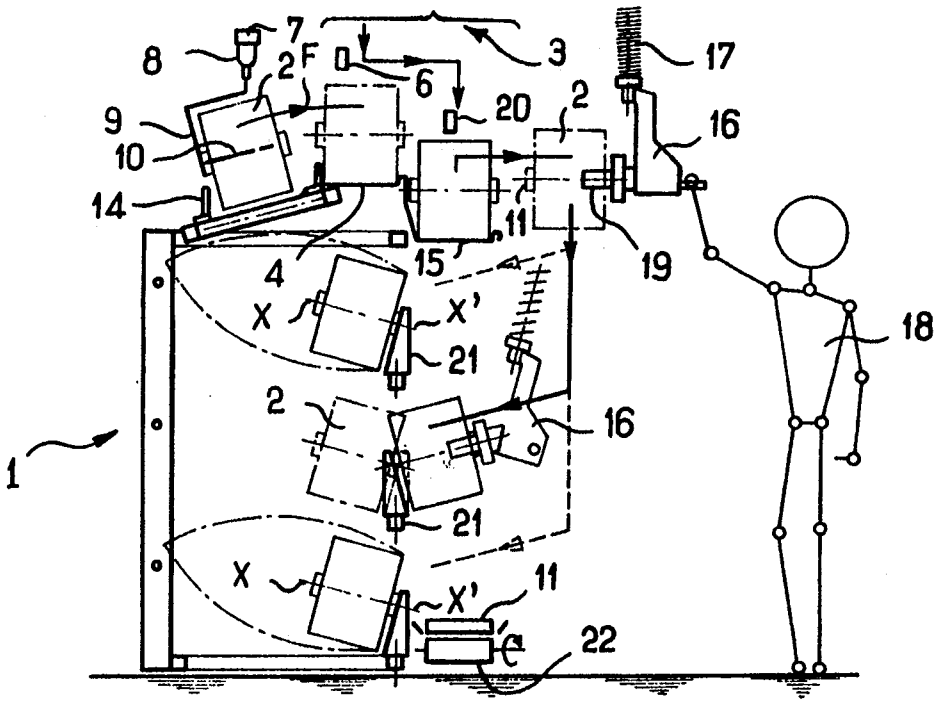
FIG. 5 is an end-on view of the rack and of the handling device for withdrawing bobbins.
Figure 6:
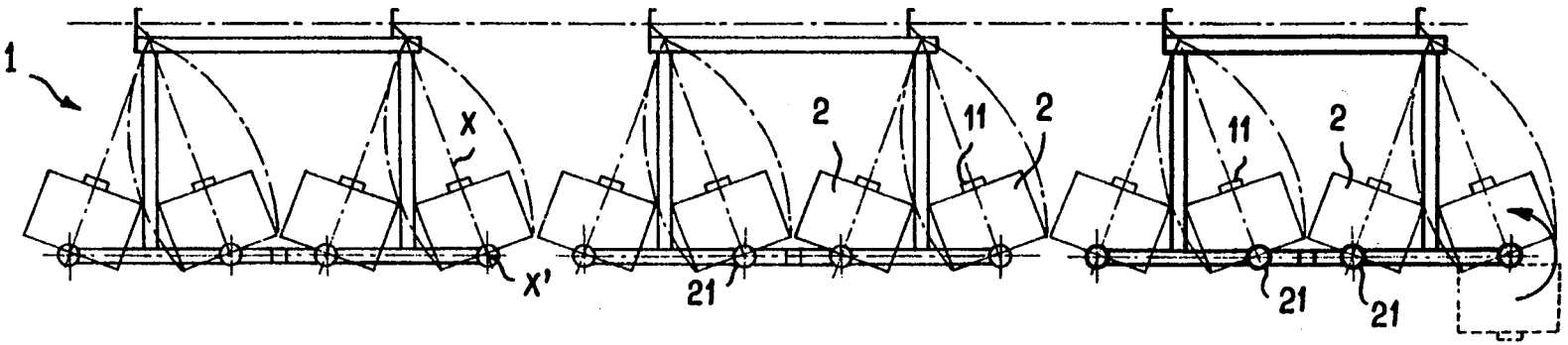
FIG. 6 is a top view of that portion of rack which is located beneath the intermediate storage zone.

In the example of FIG. 5, these means include a pusher 14 of the pneumatic type, for example, which is capable of pushing the bobbin 2 onto the ramp 4 (see arrow F in FIG. 5).

In the example of FIGS. 1, 4 and 5, the rack is provided with a second ramp 15 which extends next to the first ramp and has a slope opposite to that of the first ramp 4. The bottom end of the first ramp 4 corresponds to the top end of the second ramp 15.

Means (not shown) such as a pneumatic pusher are provided for transferring a bobbin 2 from a position at the bottom end of the first ramp 4 to the position adjacent to the second ramp 15 corresponding to its top end.

As in the case of the pusher 14, the pusher provided for this purpose is displaceable automatically at right angles to the direction of the first ramp 4.

The installation in accordance with the invention also includes means for withdrawing a bobbin 2 in any position within the storage zone and for placing it in position in the operational zone of said bobbins, which is located beneath the storage zone 3.

In the example of FIG. 5, said means include an arm 16 suspended from a weight-compensator system 17. This arm can be hand-held by an operator 18 and has an end-piece 19 which is capable of engaging and interlocking within the spool 11 of the bobbin 2 to be withdrawn.

Said end-piece 19 is capable of expanding under a control action initiated by the operator when it is engaged within the spool 11, thus enabling it to interlock with this latter and permitting withdrawal of a bobbin in order to place it in position in the rack.

The presence of a bobbin 2 at the bottom end of the second ramp 15 is detected by a detector 20. In the operational zone of the rack 1, the bobbins 2 are mounted on spindles X–X' carried by vertical arms 21 (see FIGS. 5 and 6). These arms are capable of pivoting between a position in which the spindle X–X' of the bobbin 2 projects outwards from the rack 1 and a position in which the spindle X–X' projects towards the interior of the rack. This rotation can be controlled automatically after the operator 18 has placed the bobbin 2 in the first position mentioned above.

Figure 8:
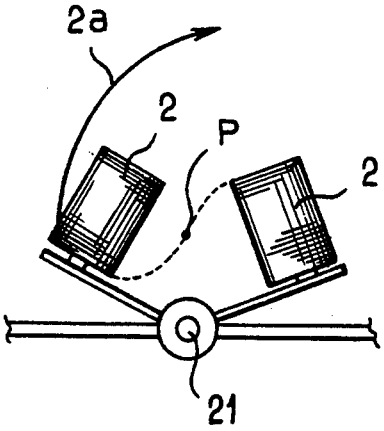
FIG. 8 is a plan view showing the junction of the filament between two bobbins placed side by side in the rack.

In FIG. 8, it is seen in particular that each pivotal arm 21 carries two bobbins 2, one being operational (in the course of unwinding) and the other being in readiness (the right-hand bobbin). The reference 2*a* designates the filament of the bobbin during the unwinding operation. Joining of the filament 2*a* of the unwound bobbin and the filament of the full bobbin is carried out at the point P.

Figure 9:
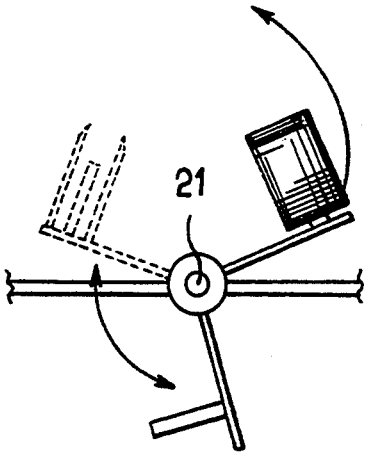
FIG. 9 is a view which is similar to FIG. 8 and shows the support of one of the bobbins in the outwardly pivoted position.

FIG. 9 shows that the supports of the two bobbins 2 are capable of pivoting independently of each other about the axis of the arm 21, thus permitting easy removal of the spool 11 of the empty bobbin in order to replace it with a full bobbin.

Figure 7:
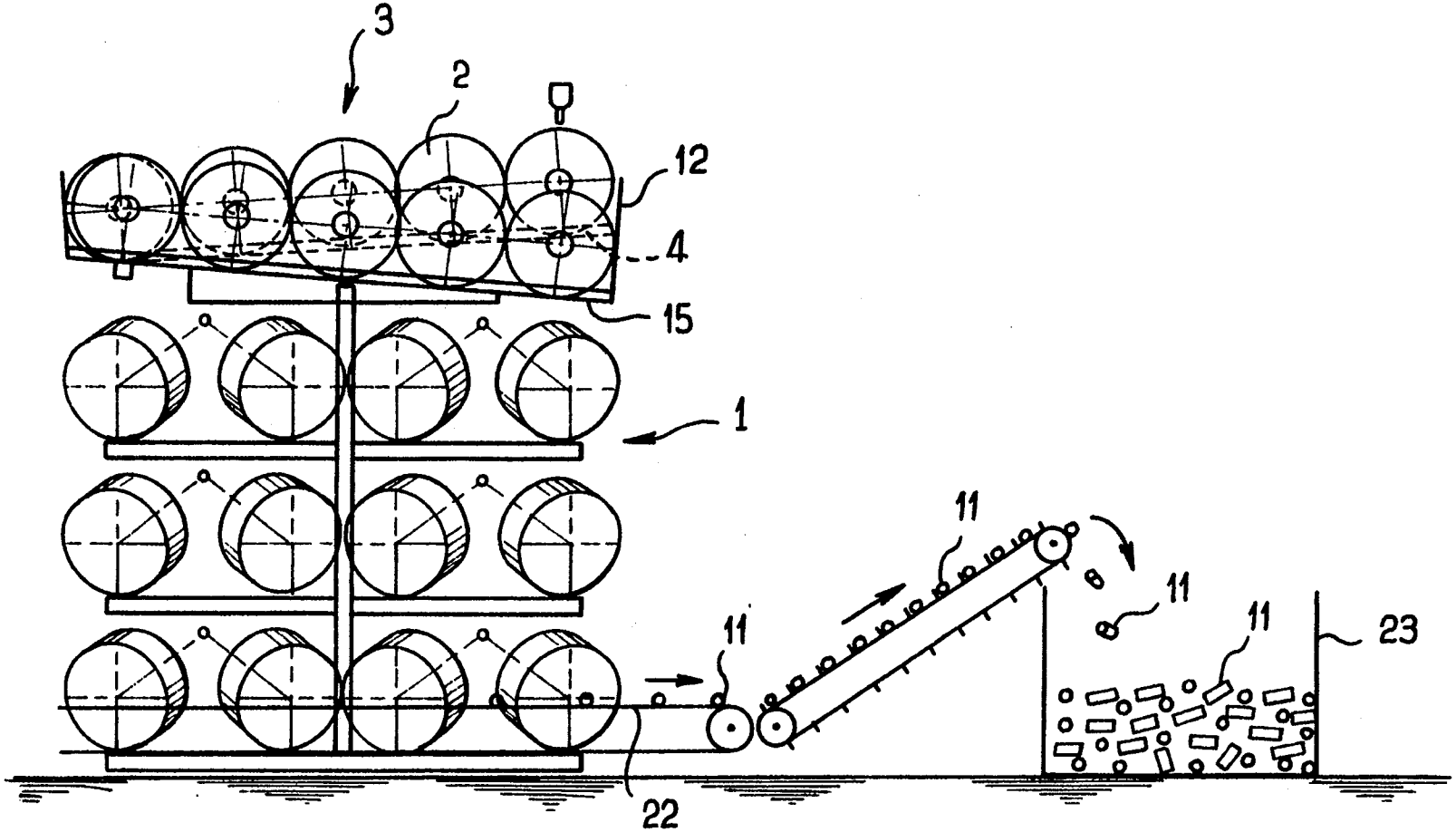
FIG. 7 is a view in elevation of one end of the rack and of a device which serves to remove the spools of the empty bobbins.

It is also apparent from FIGS. 5 and 7 that the rack 1 is provided at the bottom portion thereof with a belt-conveyor 22 for recovering the spools 11 of the empty bobbins and transferring them to a receptacle 23 for storage of said spools 11.

The operation of the installation which has just been described will now be explained.

The bobbins 2 are continuously transported along the rail 7 towards the rack 1. When the detector 6 (a photoelectric cell, for example) detects the absence of a bobbin 2 at the top end of the ramp 4, the conveyor chain stops and presents a bobbin 2 opposite the above-mentioned ramp end (see FIG. 5).

The pusher 14 pushes the bobbin 2 which is engaged on the pin 10 of the support 9 and places the bobbin 2 within the empty space at the top of the ramp 4.

When the operator 18 withdraws a bobbin 2 from the second ramp 15, the adjacent bobbin takes the place of the withdrawn bobbin by reason of the slope of the ramp 15 and the following bobbins which are present on the ramp 15 move downwards, thus leaving a vacant space at the top of said ramp.

This vacant space is detected and the pusher of the same type as the pusher 14 provided for this purpose pushes the bobbin which is present at the bottom end of the first ramp 4 towards the top end of the second ramp 15 which is located at the same level.

The vacant space formed at the bottom of the first ramp 4 is immediately filled by a succeeding bobbin as a result of the slope.

A vacant space is then detected at the top of the first ramp 4, which initiates the forward displacement of the conveyor chain and the positioning of a fresh bobbin within the vacant space mentioned above.

Withdrawal of a bobbin from the second ramp 15 is an easy matter since the axes of the bobbins or in other words the openings of their spools 11 are directed towards the operator.

It is only necessary for him to grip the arm 16 of the weight-compensation handling device, to engage the end-piece 19 of the arm within the spool 11 of the bobbin 2, and to initiate expansion of the end-piece 19.

The operator 18 then puts the bobbin 2 in position on the spindle X–X' of the arm 21 which has previously been pivoted so as to project outwards from the rack.

After disengagement of the end-piece 19 of the arm 16, the bobbin 2 is rotated, preferably automatically towards the interior of the rack. The bobbin 2 is then ready to be unwound.

When a bobbin 2 is empty, there remains the spool 11 which is removed by the conveyor-belt 22 (see FIG. 7) and directed by this latter to a receptacle 23.

Figure 10:
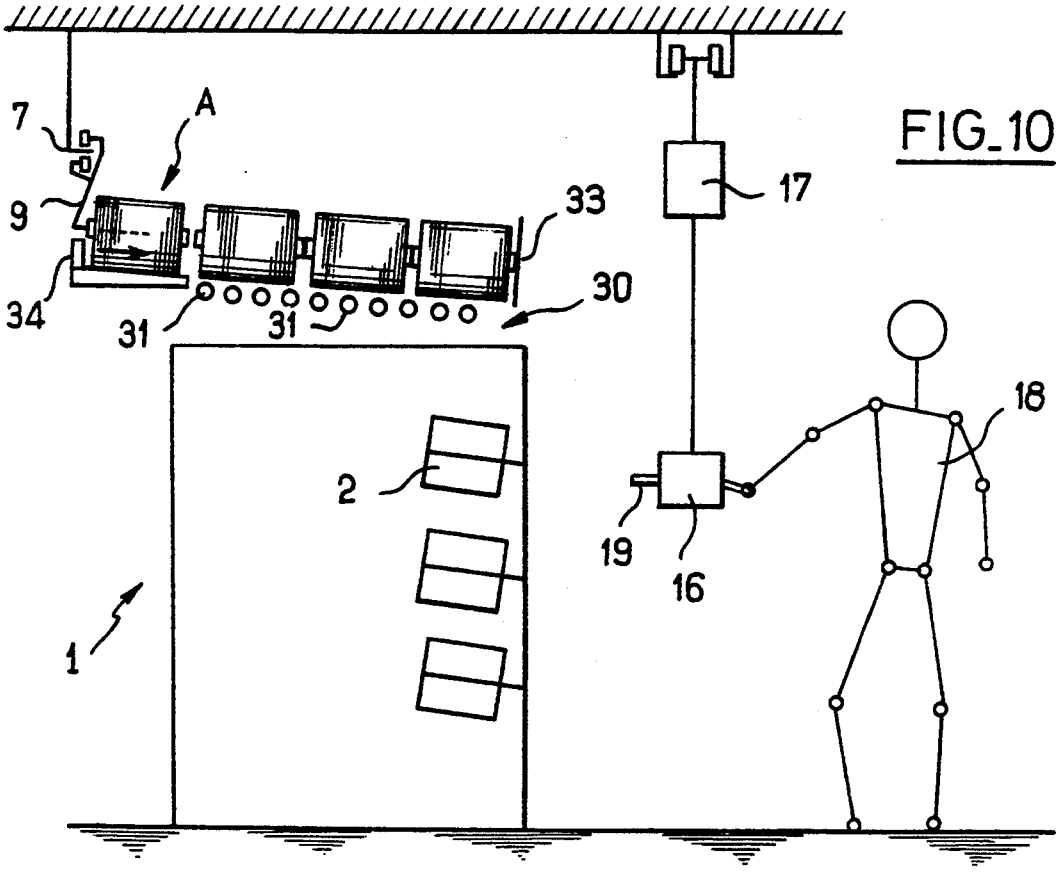
FIG. 10 is a schematic transverse sectional view of the rack, showing an alternative embodiment of the intermediate storage zone as well as the device for handling bobbins.
Figure 11:
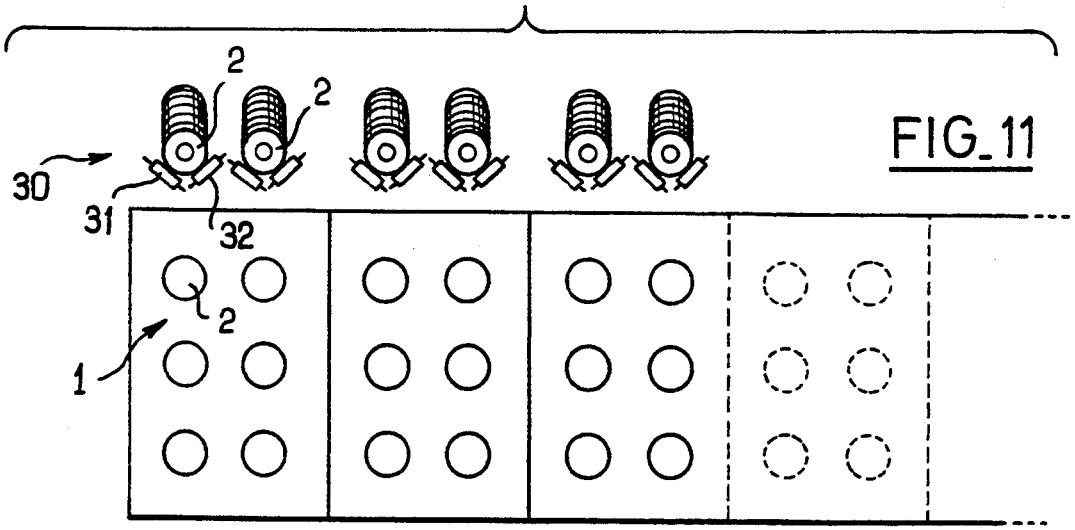
FIG. 11 is a view in elevation of the rear end of the rack and of the storage zone shown in FIG. 10.

In the alternative embodiment of FIGS. 10 and 11, the intermediate storage zone 30 includes a series of parallel rollers 31, 32 forming together a number of inclined rolling faces extending above the rack 1 transversely to the rows of bobbins located within this latter.

Each inclined rolling face is adapted to receive successive bobbins 2 in order to guide them axially along the inclined rolling face from a position A in which the conveying means 7, 9 present successive bobbins, up to a stop 33 located at the end of the inclined face.

A pusher 34 is provided for successively pushing the bobbins 2 presented in position A towards the inclined plane.

Each inclined face comprises (see FIG. 11) two rows of rollers 31, 32, the axes of the rollers 31 of one of the rows being inclined at an angle to the axes of the rollers of the other row, the vertex of which is directed downwards. These rollers 31, 32 thus form a V-section trough which guides the rolling motion of the bobbins 2 in the axial direction.

The operator can thus take a bobbin 2 on an inclined face in order to place it in the rack 1. After removal of a bobbin 2, the following bobbins roll on the rollers 31, 32 by virtue of the slope in order to fill the vacant space. A detector (not illustrated) then initiates the forward motion of the conveying means 7, 9 with a view to presenting a fresh bobbin 2 opposite to the corresponding inclined rolling face.

Figure 12:
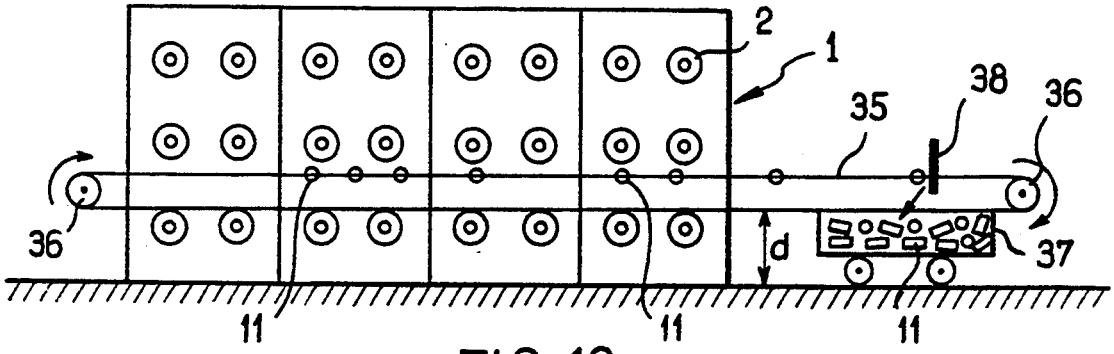
FIG. 12 is a schematic view in elevation of an alternative embodiment of the device for removing spools.
Figure 13:
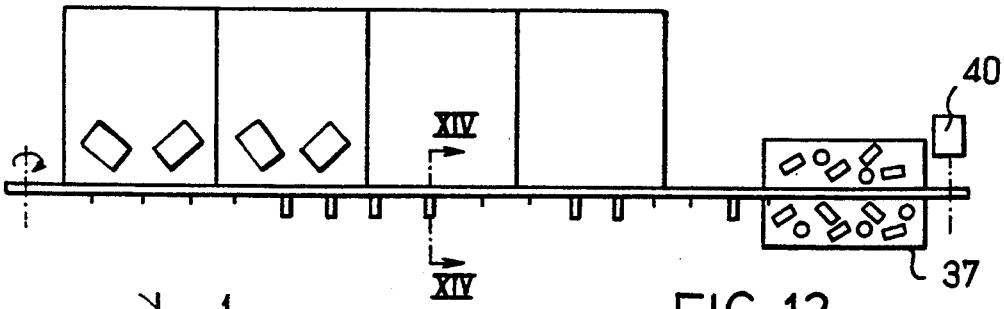
FIG. 13 is a plan view of the device shown in FIG. 12.

In the alternative embodiment shown in FIGS. 12 and 13, a chain 35 passed around two wheels 36 is provided for conveying the spools 11 of the empty bobbins to a storage receptacle 37. Said chain 35 extends along the face on which the bobbins 2 are introduced into the rack 1, at a certain distance d above the ground.

Said chain 35 is fitted with means for temporary attachment of the spools 11 and a stop 38 is provided above the receptacle 37 for storage of spools. The position of said stop 38 is such that the spools 11 which are temporarily attached to the chain 35 can strike said stop 38 in order to cause them to fall into the receptacle 37.

Figure 14:
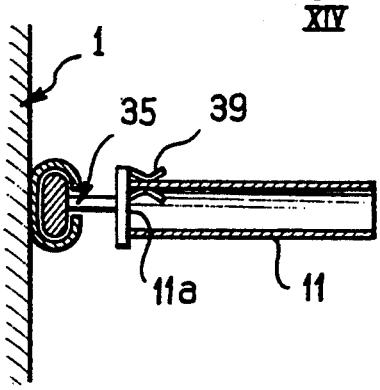
FIG. 14 is a sectional view to a larger scale taken along the plane XIV—XIV of FIG. 13.

As shown in FIG. 14, the means for temporary attachment of the spools 11 include resilient clips 39 which project from the chain 35 in a direction parallel to the ground. Each clip 39 is capable of engaging on the edge 11a of the circular opening of a spool 11 so as to hold it by gripping in the position indicated in FIG. 14.

The chain 35 can be continuously displaced by the motor 40. The operator who has the allotted task of withdrawing spools 11 from the rack can very easily fix them on free clips 39 so that the spools 11 are directed towards the stop 38 which causes them to fall into the receptacle 37.

Figure 15:
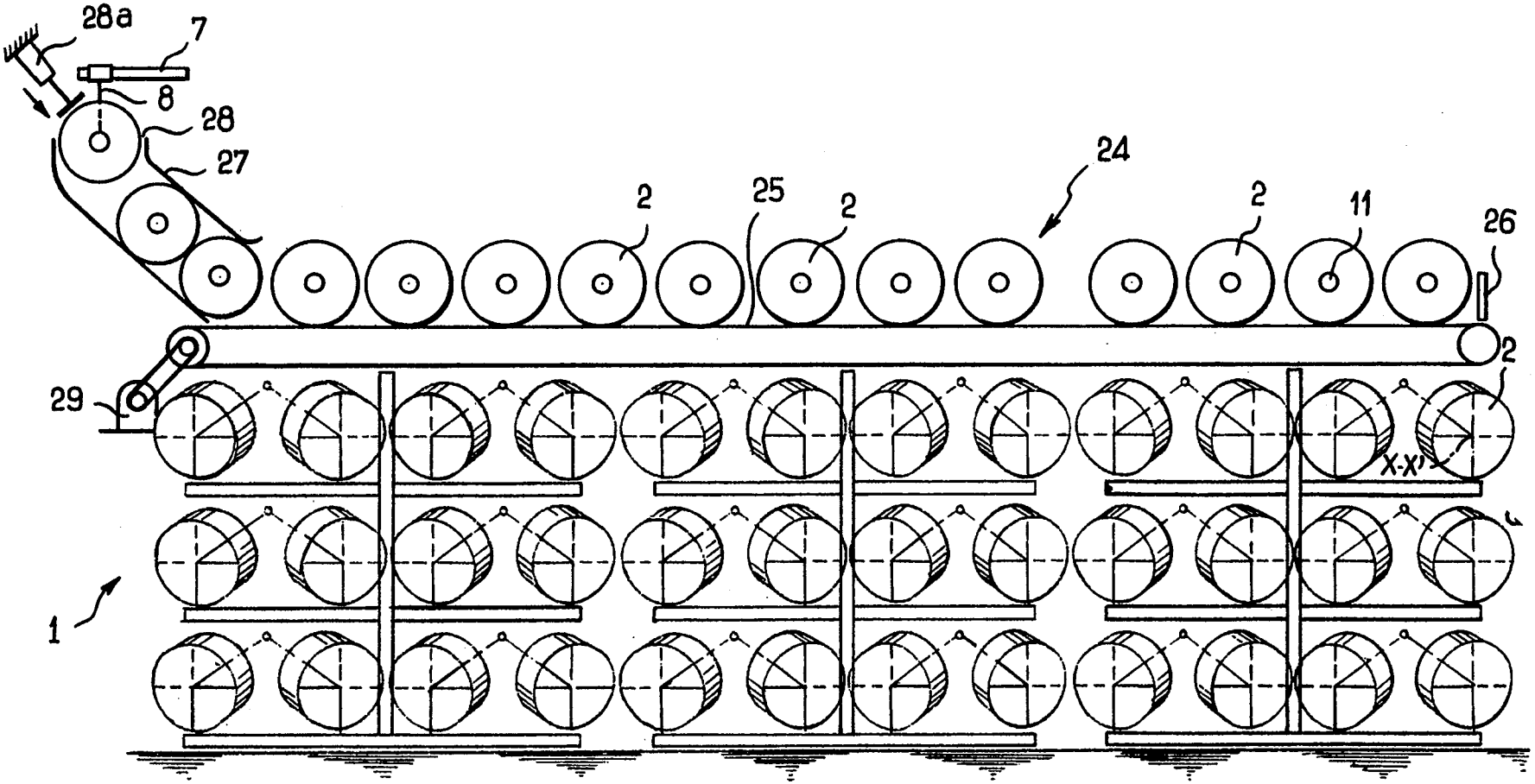
FIG. 15 is a view in elevation of a rack which includes an alternative embodiment of the intermediate storage zone.

In the alternative embodiment shown in FIG. 15, the intermediate zone 24 for storage 2 includes a conveyor-belt 25 which extends horizontally above the rack. Said conveyor-belt 25 is capable of receiving the bobbins 2 and of transporting them sequentially towards a stop 26 located at one end of the rack 1.

A chute 27 is provided at the end of the rack 1 opposite to the stop 26 for the purpose of receiving the bobbins 2 and depositing them successively on the conveyor-belt 25. The bobbin-conveying means comprising a rail 7 are adapted to present the bobbins 2 successively at a point near the inlet 28 of the chute 27. An actuator 28*a* is provided for transferring a bobbin 2 from the position mentioned above into the chute 27.

The device operates as follows:

When the operator 18 withdraws a bobbin 2 from the conveyor-belt 25 near the stop 26, a detector detects the absence of a bobbin at this location, thus initiating start-up of the motor 29 which drives the conveyor-belt 25. This latter advances by one step corresponding to the vacant space created by the withdrawal of a bobbin and the entire series of bobbins 2 located on the conveyor-belt 25 is again applied against the stop 26.

By reason of the angle of slope of the chute 27, the bobbins 2 located within this latter advance automatically so as to be applied against the remainder of the bobbins.

Thus the chute 27 is again capable of receiving a bobbin 2. A detector signals this possibility to the rail-mounted conveyor chain 7 which then advances automatically so as to present a bobbin 2 opposite to the inlet 28 of the chute 27. The actuator 28*a* then thrusts the bobbin into the inlet 28 of the chute 27.

As in the preceding embodiment, the intermediate storage zone 24 thus constituted automatically puts within the reach of the operator 18 a succession of bobbins 2 which he can thus readily place in the rack.

Figure 16:
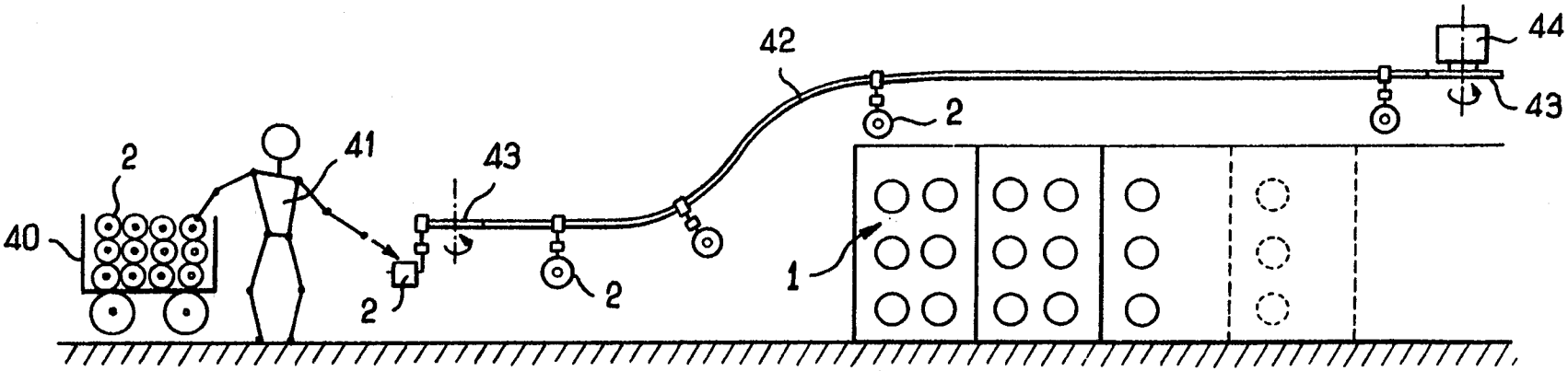
FIG. 16 is a view in elevation of an alternative embodiment of the means for conveying bobbins.
Figure 17:
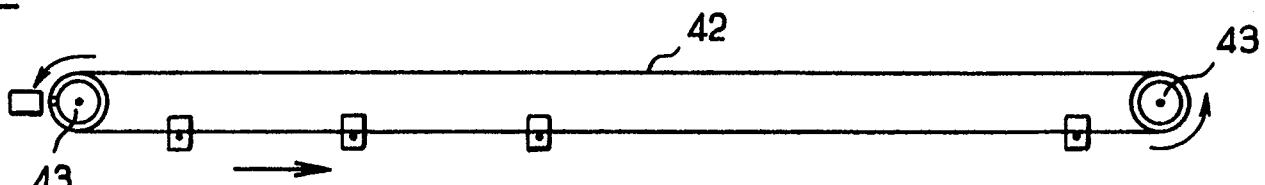
FIG. 17 is a plan view of the alternative embodiment shown in FIG. 16.

FIGS. 16 and 17 illustrate an alternative embodiment of the bobbin-conveying means. These latter make it possible to transfer the bobbins 2 to the intermediate storage zone of the rack from a bobbin-formation zone or else, as shown in FIG. 16, from a carriage 40 from which the bobbins 2 are withdrawn by hand by an operator 41.

In this example, said conveying means include an endless chain 42 passed around two wheels 43, one of which is driven by a motor 44.

Said chain 42, which is guided by suitable means, transports the bobbins along a path which starts at a low point located near the operator in order to facilitate attachment of the bobbins to the chain 42 and terminates at a high point located above the rack.

Figure 18:
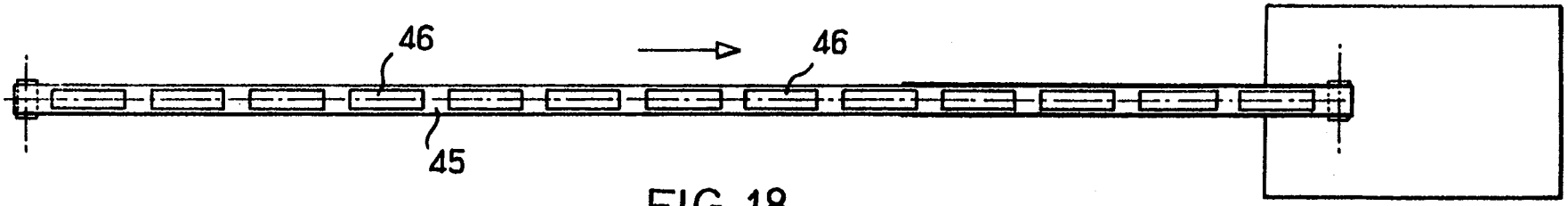
FIG. 18 is a plan view of another alternative embodiment of the means for conveying bobbins.

In the embodiment of FIG. 18, the means for conveying the bobbins to the intermediate storage zone include a conveyor-belt 45 provided with means for retaining the bobbins.

In the example illustrated, these retaining means are constituted by cups 46 placed on the belt 45. These cups can be replaced by cleats or the like.

As can readily be understood, the rack in accordance with the invention could be entirely controlled by a programmable automation which makes it possible to manage the supply of the rack and thus to distribute the bobbins in a uniform manner without favoring certain positions of the bobbins.

In particular, this programmable automation could count the bobbins in position.

In another alternative embodiment, the intermediate bobbin-storage zone could be constituted directly by the means for conveying bobbins to the rack. Thus a portion of the conveying means, for example a portion of a conveyor chain, could extend above the rack so as to define a zone in which an operator could withdraw the bobbins directly in order to place them in the rack.

Moreover, the spools obtained from the empty bobbins of the rack could be discharged by the conveying means mentioned above. In fact, after he has taken a bobbin from the conveying means, the operator could replace this bobbin by the spool of the empty bobbin which has been replaced by the above-mentioned full bobbin.

We claim:

1. Rack (1) for supporting bobbins (2) of filament, located upstream of a textile installation towards which the filament unwound from said bobbins is conveyed, said rack (1) being made up of several superposed rows of bobbins (2) mounted on spindles (X–X'), characterized in that it has a zone (3, 24, 30) for intermediate storage of bobbins (2) in which said bobbins are placed next to each other on a support (4, 25), means (7, 8) being provided for automatically conveying the bobbins (2) to said intermediate storage zone (3, 24, 30), and said intermediate storage zone (3, 24, 30) extending above said rows of bobbins (2), said storage zone (3) comprising an inclined ramp (4) on which the bobbins (2) are placed next to each other, said ramp (4) being provided at its opposite ends with walls (12, 12*a*) forming stops for the bobbins (2), said ramp (4) being inclined in the direction of the row of bobbins and being horizontal in the directions at right angles to the latter, and a second ramp (15) extending next to the first ramp (4) and having a slope opposite to that of the first ramp (4) corresponding to the top end of the second ramp (15).

2. Rack according to claim 1, characterized in that said storage zone (3) comprises at least one detector (6) for detecting the presence of a bobbin (2) in said storage zone, said detector (6) being adapted to cooperate with means for controlling the displacement of said bobbin-conveying means (7, 8) so as to fill the space resulting from withdrawal of a bobbin.

3. Rack according to claim 1, characterized in that detectors (6, 13) are designed to detect a bobbin (2) at each end of the ramp (4).

4. Rack according to claim 1, or 5, characterized in that means are provided for transferring a bobbin (2) from a position in which it is attached to the conveying means (7, 8) to the top end of the ramp (4).

5. Rack according to claim 1, further comprising means for transferring a bobbin (2) in position at the bottom end of the first ramp (4) to the adjacent position of the second ramp (15) corresponding to its top end.

6. Rack according to claims 1, said means for transferring a bobbin from one position to another position include a pusher (14) which is automatically displaceable at right angles to the direction of the first ramp (4).

7. Rack according to claim 1, characterized in that it includes means for withdrawing a bobbin in position in the storage zone (3) and for placing it in position in the operational zone of said bobbins which is located beneath the storage zone (3).

8. Rack according to claim 7, characterized in that said means include an arm (16) suspended from a weight-compensator system (17), said arm (16) being designed to be hand-held by an operator (18) and provided with an end-piece (19) which is capable of engaging and interlocking within the spool (11) of the bobbin (2) to be withdrawn.

9. Rack according to claim 1, characterized in that, in the operational zone of the rack (1), the bobbins (2) are mounted on spindles (X–X') carried by vertical supports (21) which are capable of pivoting between a position in which the spindle (X–X') projects outwards from the rack (1) and a position in which said spindle projects towards the interior of the rack.

10. Rack according to claim 1, characterized in that it is provided in the bottom portion thereof with a belt-conveyor (22) for recovering the spools (11) of the empty bobbins and transferring them to a receptacle (23) for storage of said spools (11).

11. Rack according to claim 1, characterized in that said intermediate storage zone (24) is provided with a belt-conveyor (25) which is capable of receiving the bobbins (2) and conveying them sequentially towards a stop (26) located at one end of the rack, an inclined chute (27) being provided at the end of the rack opposite to the stop (26) for the purpose of receiving the bobbins and depositing them successively on the conveyor-belt (25), said means (7, 8) for conveying the bobbins (2) being adapted to present the bobbins (2) successively at a point near the inlet (28) of the chute (27) and means (28*a*) being provided for transferring a bobbin from this position into the chute (27).

12. Rack according to claim 1, characterized in that said intermediate storage zone (30) includes a series of parallel rollers (31, 32) forming together one or a number of inclined rolling faces extending above the rack transversely to the rows of bobbins (2), each inclined rolling face being adapted to receive successive bobbins in order to guide them axially along the inclined rolling face from a position in which the means (7, 9) for conveying the bobbins (2) present successive bobbins, up to a stop (33) located at the end of the inclined face, means (34) being provided for successively pushing the bobbins (2) presented in said position towards the inclined face.

13. Rack according to claim 12, characterized in that each inclined face comprises two rows of rollers (31, 32), the axes of one of the rows of rollers (31) being inclined at an angle to the axis of the other row of rollers (32), the vertex of which is directed downwards.

14. Rack according to claim 1, characterized in that it is provided with a chain (35) for conveying the spools (11) of the empty bobbins to a storage receptacle (37), said chain (35) being such as to extend along the face on which the bobbins (2) are introduced into the rack (1), at a certain distance (d) above the ground, said chain (35) being fitted with means for temporary attachment of the spools (11) and a stop (38) being provided above the spool-storage receptacle (37), the position of this stop (38) being such that the spools (11) which are temporarily attached to the chain (35) can strike said stop (38) and fall into the receptacle (37).

15. Rack according to claim 14, characterized in that the means for temporary attachment of the spools (11) include resilient clips (39) which project from the chain (35) in a direction parallel to the ground, each clip (39) being capable of engaging on the edge of the circular opening (11a) of a spool (11) so as to hold it in position by clamping.

16. Rack according to claim 1, characterized in that the means for conveying the bobbins (2) to the intermediate storage zone include an endless chain (42) passed around at least two wheels (43), one of which is driven by a motor (44).

17. Rack according to claim 1, characterized in that the means for conveying the bobbins (2) to the intermediate storage zone include a belt-conveyor (45) which is provided with means (46) for retaining the bobbins.

18. Rack according to claim 1, characterized in that the zone for intermediate storage of the bobbins contains the means for conveying bobbins to the rack, a portion of the conveying means being such as to extend above the rack so as to define a zone in which an operator can directly withdraw the bobbins in order to place them in the rack.

* * * * *